US005557297A

United States Patent [19]

Sharp et al.

[11] Patent Number: 5,557,297

[45] Date of Patent: Sep. 17, 1996

[54] SYSTEM FOR DISPLAYING CALLIGRAPHIC VIDEO ON RASTER DISPLAYS

[75] Inventors: Daniel Sharp, Safety Harbor; Jayanti Patel, St. Petersburg, both of Fla.; Kevin Kelleher, Buford, Ga.

[73] Assignee: Smiths Industries, Florham Park, N.J.

[21] Appl. No.: 255,530

[22] Filed: Jun. 8, 1994

[51] Int. Cl.[6] ..... G09G 5/36; G09G 3/20; G09G 3/36

[52] U.S. Cl. ..... 345/136; 345/138

[58] Field of Search ..... 345/16, 17, 135–138, 345/142

[56] References Cited

U.S. PATENT DOCUMENTS 4,366,476 12/1982 Hickin ..... 345/142
5,339,092 8/1994 Johnson et al. ..... 345/138

*Primary Examiner*—Jeffery Brier
*Attorney, Agent, or Firm*—Anthony J. Casella; Gerald E. Hespos

[57] ABSTRACT

A system and method for processing analog XYZ calligraphic video signals for presentation as a stroke image on a flat panel LCD raster display screen by converting such signals in coordinated sets to digital data in a stroke frame buffer memory. The X and Y signals define column and row addresses in memory for storage of the coordinated Z digital color brightness data, which addresses correspond to pixel locations on the surface of the display screen to which the data is transferred to form the stroke image. By storing fractional bits from the X and Y digital data in the buffer memory along with the coordinated color intensity data a high resolution stroke image can be formed using a conventional sized buffer memory. Further, noise and clock conversion artifacts are minimized by saving the first point of each stroke line or vector and by using the X and Y fractional bits for beam shaping utilizing anti-aliasing discs. The discs are a set of prestored circular intensity profiles, each covering several pixels and having their respective centers variously offset by fractions of a pixel spacing from points defining the ideal center of the stroke line to be formed. Appropriate discs are successively copied to memory in overlapped manner for each pixel, based on the location of the profile center with respect to a stroke defining point in the pixel. The data output from the stroke frame buffer is thus shaped by the disc data in presenting the high resolution, anti-aliased stroke image on the raster display screen.

20 Claims, 11 Drawing Sheets

STROKE SCAN CONVERTER CCA

| | | | |
|---|---|---|---|
| 2 | 4 | 2 | 0 |
| 4 | X | 4 | 0 |
| 2 | 4 | 2 | 0 |
| 0 | 0 | 0 | 0 |

0

| | | | |
|---|---|---|---|
| 1 | 3 | 3 | 0 |
| 3 | 6X | 4 | 1 |
| 1 | 3 | 3 | 0 |
| 0 | 0 | 0 | 0 |

1

| | | | |
|---|---|---|---|
| 1 | 3 | 3 | 1 |
| 2 | 5X | 5 | 2 |
| 1 | 3 | 3 | 1 |
| 0 | 0 | 0 | 0 |

2

| | | | |
|---|---|---|---|
| 0 | 3 | 3 | 1 |
| 1 | 4 | X6 | 3 |
| 0 | 3 | 3 | 1 |
| 0 | 0 | 0 | 0 |

3

| | | | |
|---|---|---|---|
| 1 | 3 | 1 | 0 |
| 3 | 6X | 3 | 0 |
| 3 | 4 | 3 | 0 |
| 0 | 1 | 0 | 0 |

4

| | | | |
|---|---|---|---|
| 1 | 3 | 2 | 0 |
| 3 | 6X | 4 | 1 |
| 2 | 4 | 3 | 0 |
| 0 | 1 | 0 | 0 |

5

| | | | |
|---|---|---|---|
| 0 | 2 | 2 | 0 |
| 2 | 5X | 5 | 2 |
| 1 | 4 | 4 | 1 |
| 0 | 1 | 1 | 0 |

6

| | | | |
|---|---|---|---|
| 0 | 2 | 3 | 1 |
| 1 | 4 | X6 | 3 |
| 0 | 3 | 4 | 2 |
| 0 | 0 | 1 | 0 |

7

| | | | |
|---|---|---|---|
| 1 | 2 | 1 | 0 |
| 3 | 5X | 3 | 0 |
| 3 | 5 | 3 | 0 |
| 1 | 2 | 1 | 0 |

8

| | | | |
|---|---|---|---|
| 0 | 2 | 1 | 0 |
| 2 | 5X | 4 | 1 |
| 2 | 5 | 4 | 1 |
| 0 | 2 | 1 | 0 |

9

| | | | |
|---|---|---|---|
| 0 | 1 | 1 | 0 |
| 1 | 5X | 5 | 1 |
| 1 | 5 | 5 | 1 |
| 0 | 1 | 1 | 0 |

10A

| | | | |
|---|---|---|---|
| 0 | 1 | 2 | 0 |
| 1 | 4 | 5X | 2 |
| 1 | 4 | 5 | 2 |
| 0 | 1 | 2 | 0 |

11B

| | | | |
|---|---|---|---|
| 0 | 1 | 0 | 0 |
| 3 | 4 | 3 | 0 |
| 3 | X6 | 3 | 0 |
| 1 | 3 | 1 | 0 |

12C

| | | | |
|---|---|---|---|
| 0 | 1 | 0 | 0 |
| 2 | 4 | 3 | 0 |
| 3 | 6X | 4 | 1 |
| 1 | 3 | 2 | 0 |

13D

| | | | |
|---|---|---|---|
| 0 | 1 | 1 | 0 |
| 1 | 4 | 4 | 1 |
| 2 | 5X | 5 | 2 |
| 0 | 2 | 2 | 0 |

14E

| | | | |
|---|---|---|---|
| 0 | 0 | 1 | 0 |
| 0 | 3 | 4 | 2 |
| 1 | 4 | X6 | 3 |
| 0 | 2 | 3 | 1 |

15F

SYSTEM FOR DISPLAYING CALLIGRAPHIC VIDEO ON RASTER DISPLAYS

BACKGROUND OF THE INVENTION

1. Field of the Invention

The present invention relates to video graphics and more particularly to a system and method for processing analog calligraphic video signals to convert them into digital data suitable for presenting stroke images on a raster display device such as a flat panel LCD display.

2. Problem to be Solved

Calligraphic video signals consist of a series of analog voltage signals indicative of X, Y, and Z components which may be used to produce an illuminated track or stroke on a display surface, such as the phosphor screen of a cathode ray tube (CRT). In a CRT, an electron beam illuminates the phosphors and in an XYZ CRT monitor the calligraphic signals are usually encoded for direct use in controlling the beam. Each X component is indicative of an X-deflection of the beam, i.e., a horizontal position on the screen, while each Y component indicates a Y-deflection or a vertical position on the screen. Each Z component is indicative of the brightness to be produced by the beam at the position defined by its coordinated X and Y components. A stroke image is thus produced by appropriately controlling the successive X, Y, and Z component combinations to produce an illuminated track on the screen.

While a CRT monitor can use the analog calligraphic signals directly, video displays typically use a raster scan system and XYZ calligraphic analog voltage signals cannot be used by a raster system without conversion. In a raster display, to form an image the beam is regularly swept from side to side across the surface of the screen in a raster action beginning at the upper left hand corner and proceeding in a series of successive lines to the bottom of the screen. The beam is then returned to the upper left hand corner to begin the next sweep. During the sweep, the Z component signals produce illuminations at successive positions in each line. Each illumination is indicative of the brightness to be produced by the beam at the respective positions defined by the Z component's coordinated X and Y components. Each image is thus formed by the series of illuminations along the prescribed raster lines in keeping with the successive X, Y, and Z component combinations. For such an operation it is convenient to use a frame buffer memory for storing the Z component signals digitally at addresses indicated by their respective X and Y coordinates. The contents of the buffer memory can then be used to appropriately control the illumination of the phosphors of the pixels of the display to create the succession of images defined by the video input signals.

In a typical video raster display, the beam after each sweep is returned at zero intensity to begin the sweep for the next image. In some applications, for example, in avionics displays, the intensity and the position of the beam have been controlled during the return to produce a form of overlay on the raster video image displayed. This overlay is what is referred to as a "stroke" or "stroke image" and is determined and controlled by analog voltage inputs of calligraphic video signals. Currently, in avionics applications flat panel LCD displays are replacing the conventional phosphor screen display with the attendant desirability of digital processing of the video signals since such displays conveniently use previously-mentioned frame buffers in the form of digital memories with each memory location in a buffer representing a location corresponding to a pixel on the display screen surface. The digital frame buffer contents are periodically transferred to produce a successive set of images on the display surface in accordance with successive sets of digital data supplied to the buffer. It is therefore necessary to convert the successive sets of calligraphic analog voltage signals to successive sets of digital data in the frame buffer, which data is transferred as pixel exciting signals to produce the distinctive illuminated strokes on the display for the overlay formation on the video images.

Although analog to digital conversion is normally straightforward and can be readily applied to video raster scan conversion, effective stroke scan conversion requires a different approach. Stroke symbology by its nature has a much higher resolution than conventional video and also must be presented with high quality anti-aliasing. Therefore, simple digitizing and storing of stroke symbology in a frame buffer would not only require a very large frame buffer to maintain the resolution, but additionally the scan conversion rate required to scale the stroke to an appropriate size to match the display size would be very high. Currently, memory components are not commercially available that can handle the requisite high speed. Further, other conversion artifacts must be considered, such as noise quantization, wherein small noise levels in the X and Y deflection signals can be magnified to full pixel position variation, and clock jitter quantization, wherein the apparent end points of the lines can vary by a pixel in a rhythmic manner due to beat frequencies between the display generator digital-to-analog (D/A) clock and the local analog-to-digital (A/D) clock.

3. Objects of the Invention

It is accordingly an object of the invention to convert XYZ calligraphic video signals to be presented as a stroke image on a raster display to digital data stored in a conventional frame buffer for the display.

It is a further object of the invention to provide a system and method for converting calligraphic video analog voltage signals to corresponding digital data capable of storage in a frame buffer from which it is used to produce high resolution graphic images on a raster display.

It is another object of the present invention to provide a system and method for digitally processing calligraphic video signals for suitable storage in a frame buffer and high resolution presentation on a raster display.

It is also an object of the invention to provide a system and method for converting calligraphic video analog voltage signals to corresponding digital data capable of producing high resolution, anti-aliased, stroke images on a flat panel LCD raster display.

SUMMARY OF THE INVENTION

The present invention involves a system and method for processing analog voltage signals, that are representative of calligraphic video images to be presented on a raster display screen, by converting such signals to digital data in a stroke frame buffer, which data is appropriately processed for periodic transfer to the display screen to produce graphic video images thereon. The stroke frame buffer, in the form of a digital memory, stores the digital data in a manner suitable for displaying it as a corresponding stroke image on a raster display by storing the data at addresses in rows and columns corresponding to pixel locations on the surface of the display screen. The analog signals consist of sets of X, Y, and Z components of a calligraphic image, i.e., the horizontal and vertical locations of each point on the display screen making up the image track or stroke, and the respective color brightness of each of the points. In terms of the raster, each X component is indicative of an X-deflection of the beam, i.e., the horizontal position of a stroke point on the screen corresponding to the point of intersection of the beam and a pixel on the surface of the screen. More than one point may fall within one pixel. Each Y component is indicative of a vertical deflection of the beam or, in other words, the raster line which is to contain the stroke point defined by the X component in its set. Each Z component indicates the intensity of the stroke point at the screen location defined by the X and Y components of its set and contributes to producing a corresponding color brightness of the pixel at that location on the screen.

In accordance with the invention, the problems posed by the high scan conversion rates and large frame buffer sizes that would be required when using conventional conversion techniques are overcome by digitizing the stroke intensity data to a fractional, e.g., ¼, pixel resolution through storing fractional bits from the X and Y digital deflection data in the stroke frame buffer along with the color intensity data. Further, the noise and clock conversion artifacts are minimized by saving the data for the first and last point of each stroke line or vector and by using the X and Y fractional bits for beam shaping utilizing anti-aliasing discs. The discs are a set of prestored circular intensity profiles, e.g., 16, each covering several pixels and corresponding respectively to 16 sets of X and Y fractional bits, so that any variation in intensity is limited to a ¼ pixel, which is not detectable by the human eye. The data output from the stroke frame buffer is shaped by the disc data in presenting the stroke image on the raster display.

Accordingly, analog signals indicative of coordinated sets of X, Y, and Z components are input through appropriate preamplifying and filtering circuitry to respective analog-to-digital (A/D) converters and the digital output signals are stored, after processing, in a stroke frame buffer memory and in a raster frame buffer memory. The digital output signal corresponding to the X component in a set defines a column address in the buffer, while the Y component signal of the set defines a row address in the buffer. The corresponding Z signal determines the digital value of the brightness that is stored at the row and column address defined by the respective X and Y signals. The video Z signal has four components (R, G1, G2, B), which are stored in the raster frame buffer memory, and the stroke Z signal has three components (R, G, B), which are stored in the stroke frame buffer memory. Fractional bits from the X and Y signals, i.e., the two least significant (LSB) X and Y bits, are also stored with the brightness digital value in the stroke frame buffer memory. Successive sets of analog signals are converted by the A/D converters to digital data in the frame buffers in this manner until the buffer memories are appropriately filled. The data in the two buffers is periodically transferred under the control of a suitable sequencer, with the stroke frame buffer data being shaped by the profile technique, for display on the raster display device during the raster sweep. The resulting image is a graphic video image overlaid on the video image produced during the raster sweep. Ping-pong memories are used in the buffers to facilitate rapid transfer and the system is provided with appropriate anti-aliasing circuitry, filtering, and clock signal generating and coordinating means to achieve optimum images and operation. dr

DETAILED DESCRIPTION OF THE PREFERRED EMBODIMENT

The preferred embodiment of the present invention will be described in terms of the use of A/D flash converters and a flat panel LCD raster display with a quad pixel arrangement, but it will be understood that many of the described components in the system and features in the method set forth may be substituted for and other alterations may be made by those of skill in the art within the scope of the invention.

Figure 1:
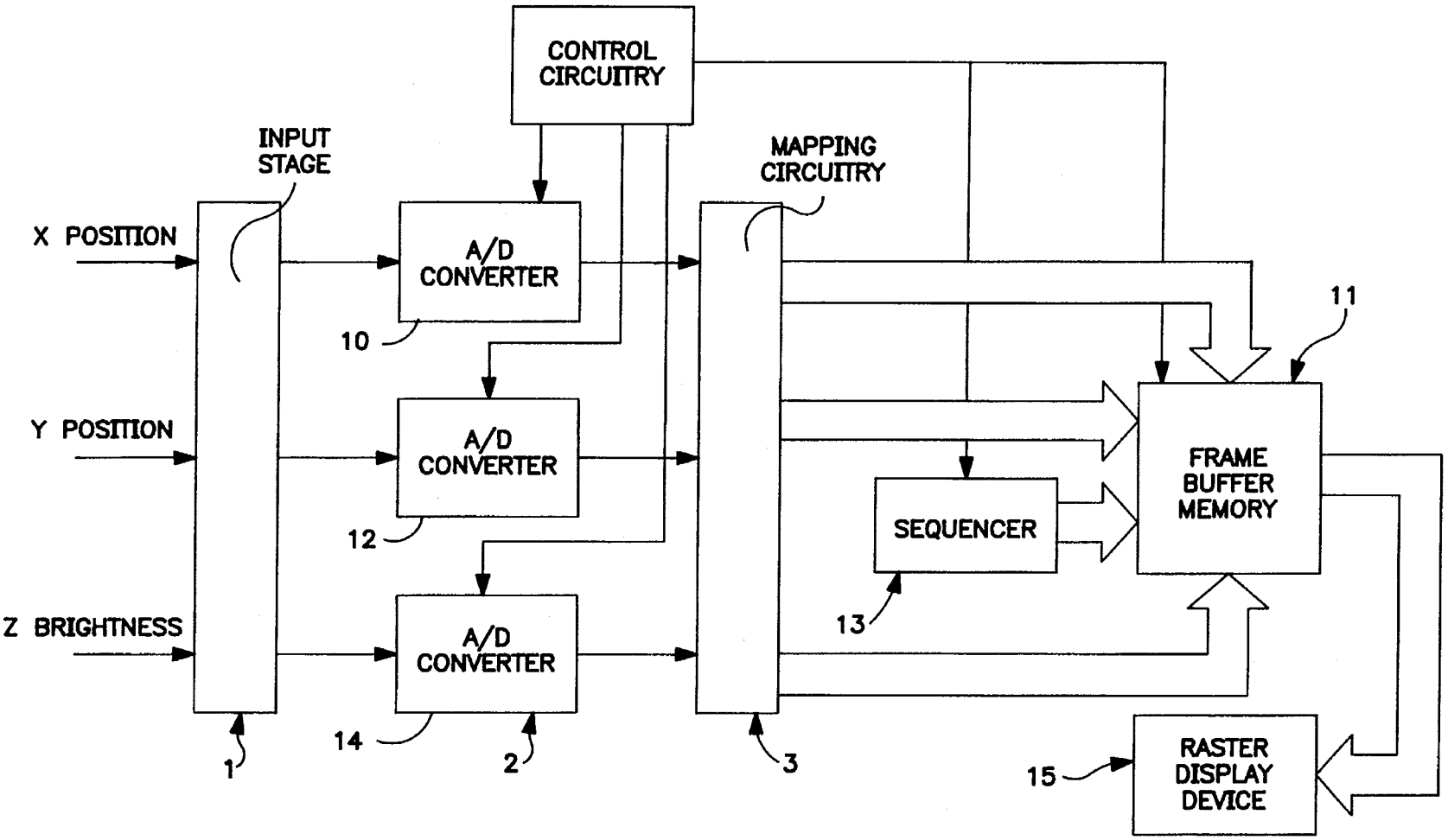
FIG. 1 is a block diagram of a system for processing XYZ analog signals to convert them to digital data for storage in a frame buffer memory and use in presenting a stroke graphic image on a raster display device in accordance with the present invention.

A block diagram of a system for processing sets of calligraphic analog XYZ signal voltage inputs in accordance with the invention is shown in FIG. 1. The system is incorporated into the circuitry of a raster video device, such as an avionics video display, and generally comprises an input stage 1, for receiving X position, Y position, and brightness (Z) indicative analog voltage signals in coordinated sets, and a converter stage 2 with respective A/D converters 10, 12 and 14. The calligraphic analog signals, as well as signals indicative of a video image to be displayed, are converted by the respective A/D converters into digital data that are processed in mapping circuitry 3 to produce signals indicative of a column address, a row address, and a brightness value in a frame buffer memory component 11 to which the signals are supplied. Alternatively, the brightness signals may be converted by an ON/OFF comparator, rather than an A/D converter, if the strokes to be produced on the display are of a monochrome on/off type. The contents of the frame buffer memory component 11 are periodically output under the control of a suitable sequencer 13 to a raster display device 15 for displaying a corresponding video image and overlaid stroke or graphic image on its screen. In the preferred embodiment the display screen is a flat panel, color, active matrix LCD display (AMLCD) with a quad pixel arrangement.

Figure 2A:
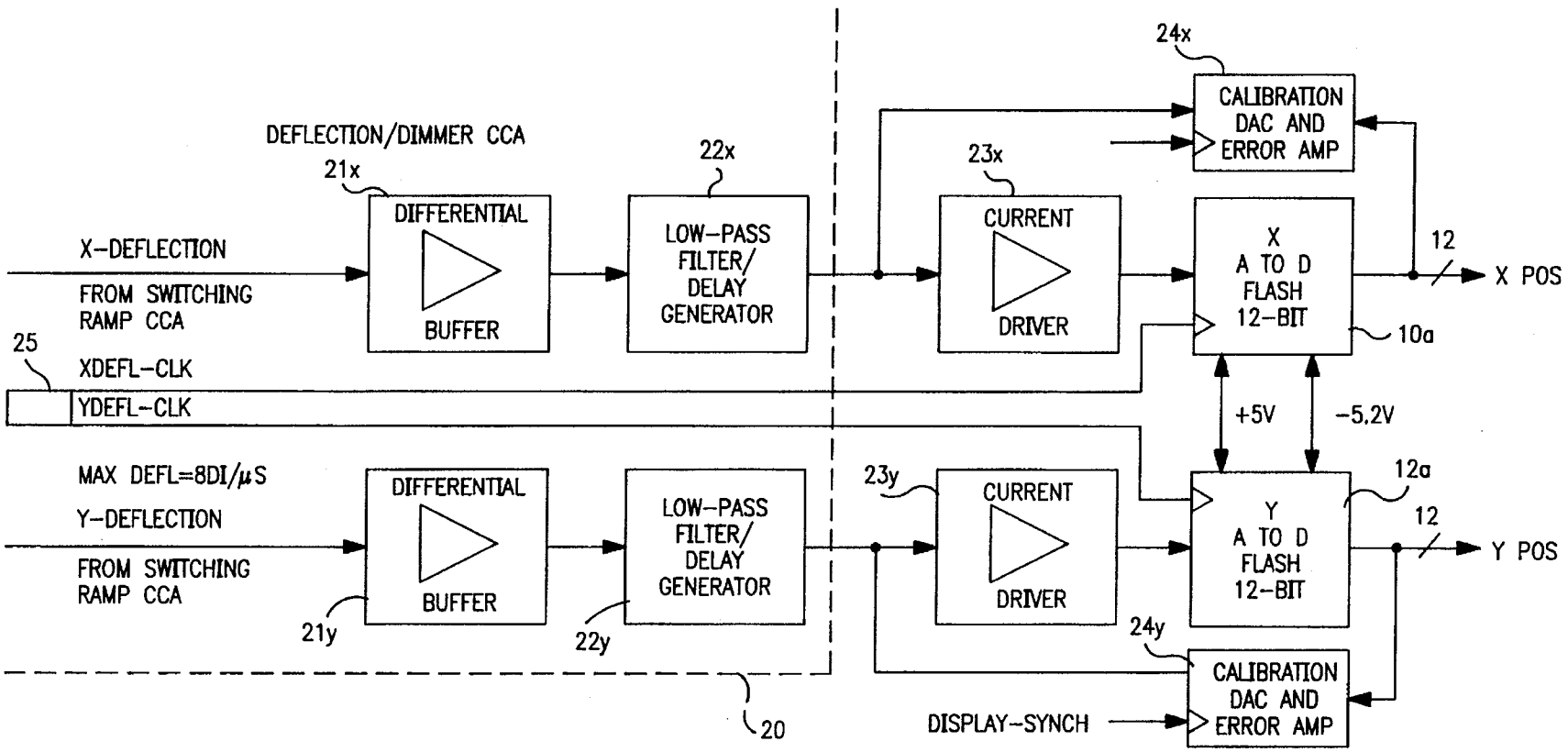
FIG. 2 is a block diagram in greater detail of the input processing components and A/D converters of the system of FIG. 1.
Figure 2B:
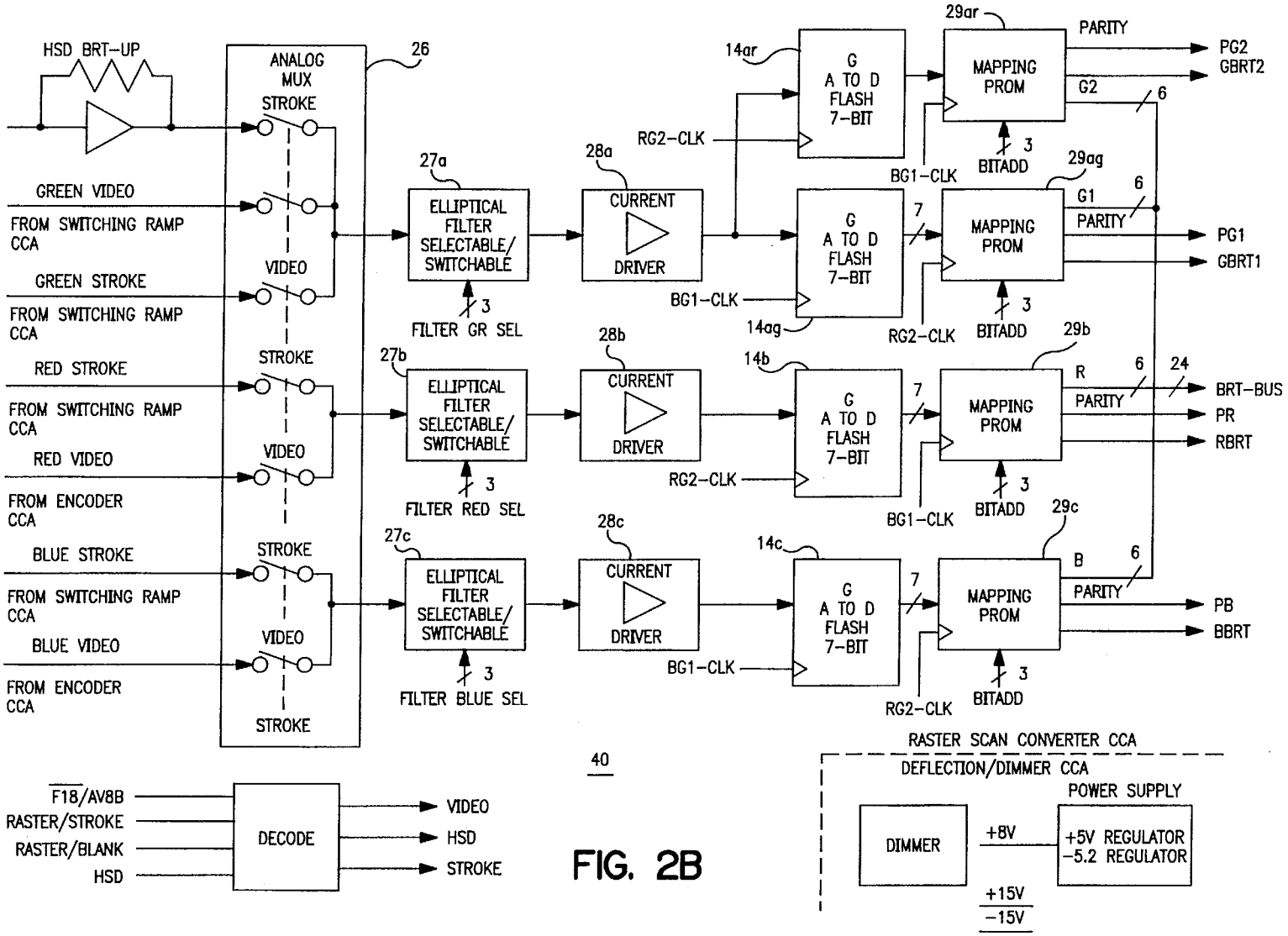

The input stage and A/D converters are shown in greater detail in FIG. 2. As seen in the upper part of the figure, the X and Y deflection signals of a set, which are input from a switching ramp circuit card assembly in the video device (not shown), are processed through differential buffers 21*x* and 21*y* and low-pass filters 22*x* and 22*y* on the deflection/dimmer 20, also on a circuit card assembly (CCA), to respective current drivers 23*x* and 23*y*. The current drivers 23*x* and 23*y* feed the processed analog signals to X and Y A/D converters 10*a* and 12*a*, preferably 12-bit A/D flash converters, provided with feedback error amplifiers 24*x* and 24*y*. The outputs of the flash converters are 12 bit digital signals indicative of the X and Y positions in a frame buffer memory for storage of the illumination value indicated by the Z signal of the set. A deflection clock 25 is provided in the deflection/dimmer circuitry 20 for producing a clock pulse to coordinate the timing of the outputs of the converters 10*a* and 12*a*.

As shown in the lower portion of FIG. 2, the Z stroke (for a monochrome stroke) signal is processed along the green video data in raster scan converter circuitry 40 on a CCA containing switching circuitry 26, elliptical filters 27*a*, 27*b* and 27*c*, and current drivers 28*a*, 28*b* and 28*c*. Since the output images for description purposes are to be displayed on an AMLCD display with a quad pixel arrangement, it will be noted that the Z signals representing three color (RGB) strokes are input via the red, green and blue stroke signals to the switching circuitry 26. The input signals include red and blue and green stroke and green video signals from a switching ramp CCA, and red and blue video signals from an encoder CCA. The processed analog outputs in green, red, and blue sets are fed from the current drivers (28*a*, 28*b*, 28*c*) to A/D converters 14*ar*, 14*ag*, 14*b*, and 14*c*, preferably 7-bit A/D flash converters, each having a mapping programmable read-only-memory (PROM), 29*ar*, 29*ag*, 29*b*, and 29*c*, at its output. For AMLCD display purposes, it will be noted that an additional A/D converter 14*ar* is provided in one circuit leg, and that this converter along with its mate 14*ag*, have respective RG2 and BG1 clock inputs, while converters 14*b* and 14*c* respectively have the same clock inputs. The four digital output signals G2, G1, R, and B, to be used to drive the LCD display, are fed in the form of a 24 bit signal (6 bits per color) to a brightness bus 31 for input to raster scan converter circuitry 40 (see FIG. 4), and in the form of a 12 bit RGB signal, along with the 12 bit X and Y position signals, to stroke scan converter circuitry 30.

The 12 bit position signals X and Y are fed to a start pixel detection circuit 32 and the 12 bit brightness signals Z to a stroke brightup generator 33 (see FIG. 3), both of which devices are controlled by a green video clock/deflection clock signal from a phased clock generator 34, with a programmable clock delay, in the deflection/dimmer circuitry 20. Phased clock generator 34 also outputs red and blue video clock signals. The start pixel detection circuit 32 outputs a start point protect signal that functions to specifically preserve the starting point of each stroke line, by saving the point in storage, to minimize jitter for anti-aliasing purposes. The stroke brightup generator 33 generates a stroke bright-up signal for disabling stroke writing to memory during blank stroke, stroke beam repositioning, and raster graphics. A start point protect signal and a stroke brightup signal from the respective devices, 32 and 33, are fed to a stroke update controller 35 which also receives a green video clock/deflection clock input from the phased clock generator 34 as well as raster/stroke and stroke sync signals, the latter from a cathode reset detector 18 in the video device. The output of the stroke update controller 35 is provided to a stroke frame buffer control multiplexer 36, along with a ping/pong swap control signal from the deflection/dimmer circuitry 20 and an LCD/stroke Read/Write RAM control signal from an LCD controller 37 in the raster scan converter CCA 40. The stroke frame buffer control multiplexer 36 outputs stroke ping control signals sp1 and stroke pong control signals sp2 to a stroke frame buffer 43 which contains a ping-pong memory (43*a* and 43*b*) as shown in FIG. 4.

The ping/pong frame buffer configuration allows one half of the buffer memory to be dedicated to updating stroke graphics while the other half is being read to generate data to refresh the display. Typically the ping/pong memories are swapped at a 30 Hz rate under control of the raster scan converter circuitry 40 and the LCD display is updated at a 60 Hz rate. With an AMLCD display, however, the display is driven with the same data for two consecutive fields (field 1/field 2) to allow the display drivers to reverse the drive polarity between fields in order to eliminate DC plating effects on the AMLCD glass. In such a case, every other stroke field is discarded and the display update rate is 30 Hz.

Figure 3A:
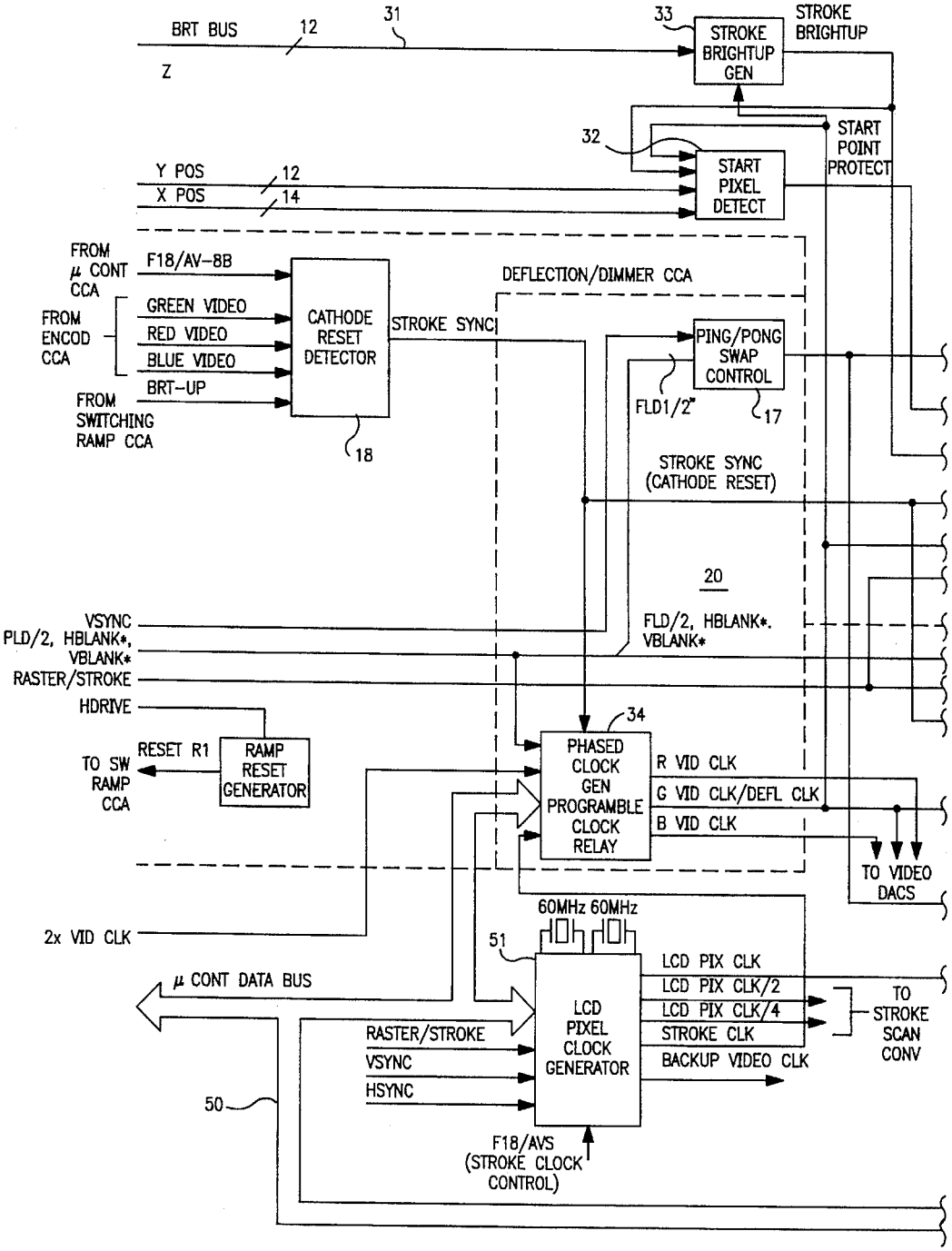
FIG. 3 is a block diagram for the timing and control circuits of the raster scan converter and stroke scan converter for controlling the raster and stroke scan signals in implementing the control circuitry of the system shown in FIG. 1.
Figure 3B:
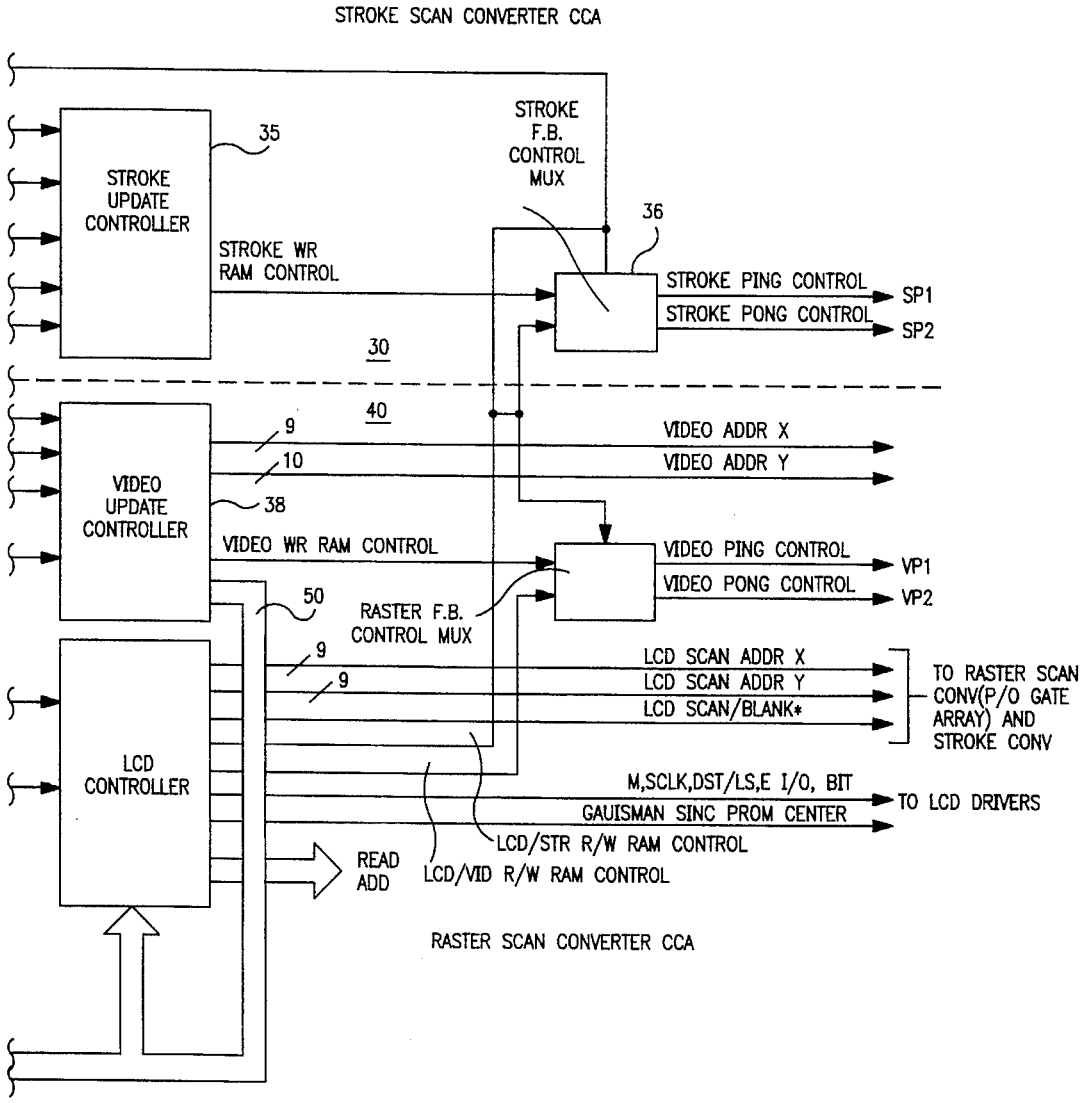

A video update controller 38, shown in FIG. 3, is also part of the raster scan converter circuitry 40 and receives the raster/stroke and stroke sync signals as well as field 1/field 2, horizontal and vertical blanking signals and a green video clock/deflection clock signal from the phased clock generator 34. The output of the video update controller 38 consists of a 9 bit video address X signal and a 10 bit video address Y signal, which are fed through a +1 adder circuit and address multiplexer 42 to the ping-pong memories 41*a* and 41*b* of raster frame buffer 41 (see FIG. 4), and of a video write RAM control signal, which is input to a raster frame buffer control multiplexer 39. There is also an output from controller 38 to a microcontroller data bus 50. The raster frame buffer memories control multiplexer 39 output a video ping control signals rp1 and video pong control signals rp2 to raster frame buffer 41*a* and 41*b*. The LCD controller 37, which receives a ping-pong swap control signal from a controller 17 and an LCD pixel clock signal from an LCD pixel clock generator 51, as well as an input from the microcontroller data bus 50, outputs a 9 bit LCD scan address X signal and a 9 bit LCD scan address Y signal to an address multiplexer 44 (see FIG. 4) which provides 9 bit X and Y addressing inputs to the stroke frame buffer ping-pong memories 43*a* and 43*b*.

Figure 4A:
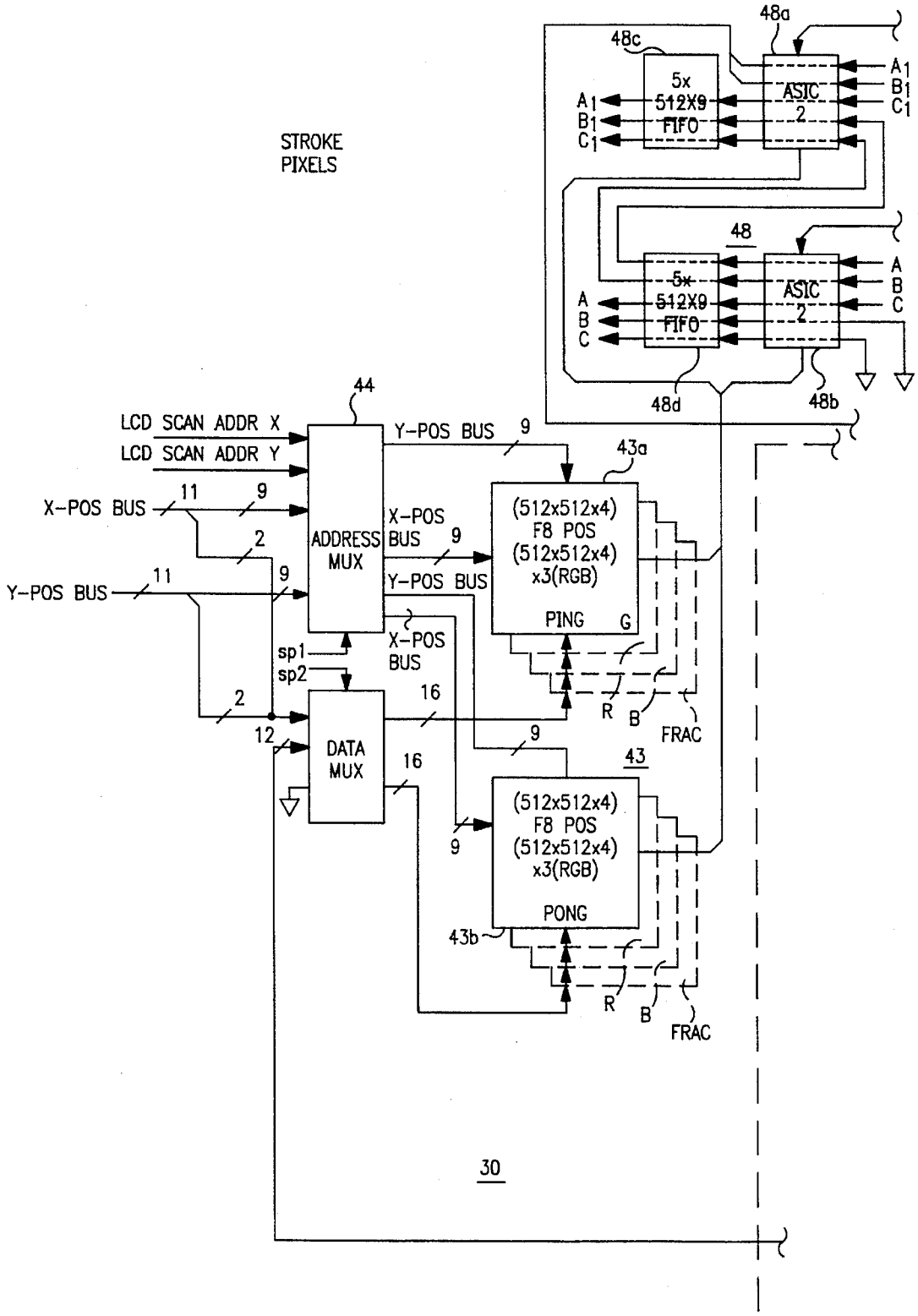
FIG. 4 is a schematic of raster frame buffer and stroke frame buffer memories with the associated control circuitry for producing video and stroke images on a LCD display.
Figure 4B:
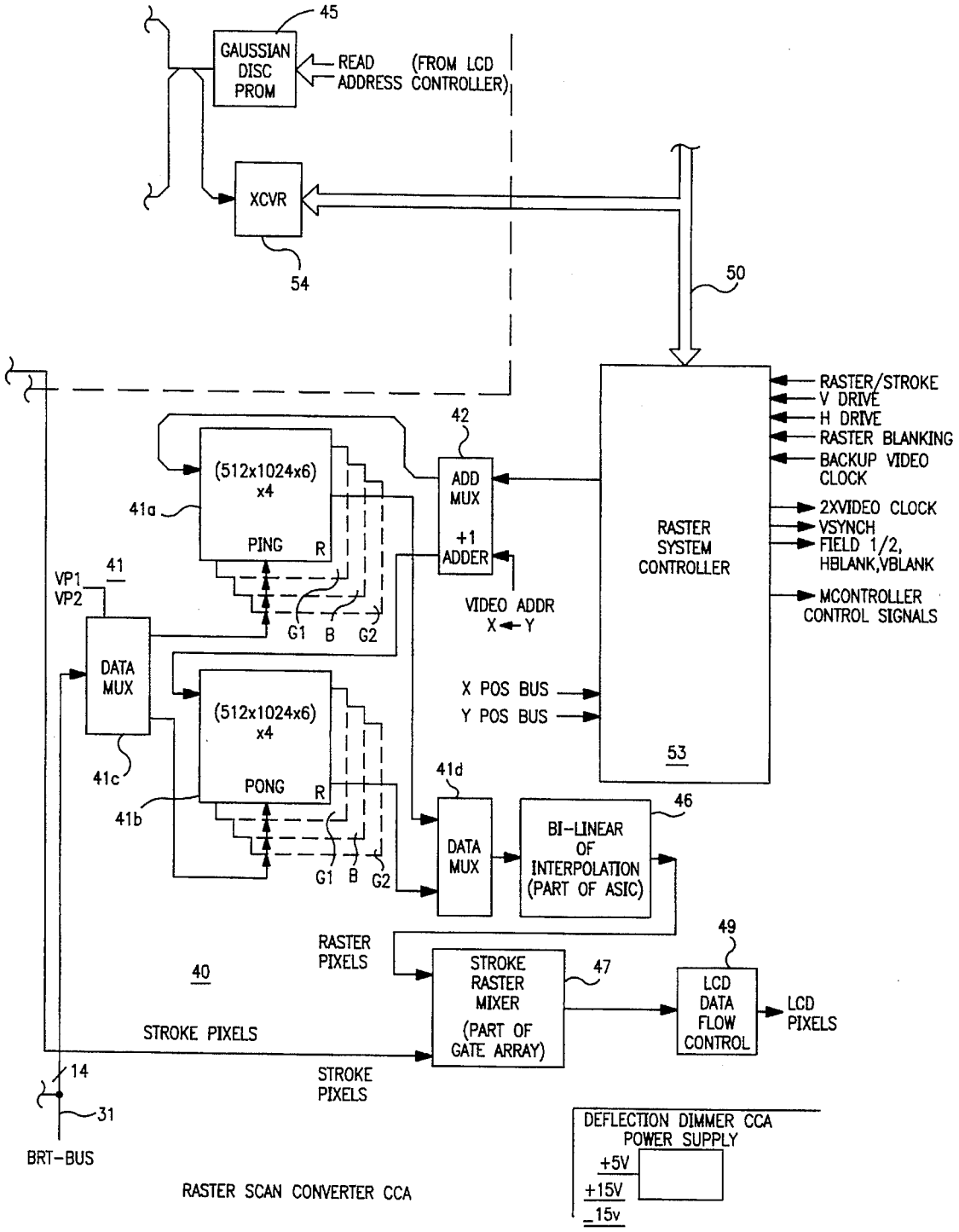

As seen in FIG. 4 and in accordance with the invention, respective 11 bit signals on the X position bus and the Y position bus have their 9 most significant bits (MSB) input to the address multiplexer 44 and their 2 least significant bits (LSB) input to the data multiplexer 43*c*. The 9 MSB bits are representative of the X and Y position of the pixel to be illuminated and the fractional 2 LSB bits are indicative of the location within the pixel. The multiplexer 44 uses the 9 X and Y digitized deflection MSB bits to address a memory location in each of the ping-pong memories, 43*a* and 43*b*, in stroke frame buffer 43.

The 24 bit signals on the brightness bus 31 (bottom of FIG. 4) have 12 bits input, along with the previously-mentioned sets of 2 LSB bits from the X-position and Y-position busses, to data multiplexer 43*c*, which in turn provides 16 bit inputs for storage in the locations in stroke frame buffer memories 43*a* and 43*b*. The 12 MSB bits of the 16 bit input include 4 bits to respectively indicate each of the three color (RGB) brightnesses for a given pixel, while the 4 LSB bits are used to determine where within the illuminated pixel the indicated brightness is to occur in a manner providing ¼ pixel resolution as will be described below.

Each buffer memory, 43*a* and 43*b*, may have a 512×512 memory array with 16 planes. As the RGB stroke intensity data comprises 4 bits for each color being written to a memory location along with the two lowest (LSB) X and Y position bits for that location, the 512×512 memory with the fractional position bits results in an effective 2048×2048 stroke resolution. Thus improved stroke resolution is obtained using a conventional sized buffer memory, and each location in memory corresponds to a pixel color group on the LCD display.

The improved resolution is combined with improved anti-aliasing through the use of a shading profile disc generator in a manner as will now be described.

A display pixel may be considered to be divided into 16 locations or points. Preferably the stroke data will be digitized at least four points per pixel on the display. As each storage location within the frame buffer memory corresponds to one pixel on the display, one of the four digitized points will be selected for storage and the others discarded. In accordance with the invention, the first point of a stroke line is selected and its data is saved, and any other points within the pixel in which the first point is located are discarded. In subsequent pixels, the data of the last point within the pixel is stored and previous stroke line points in the pixel are discarded. Of course, if the stroke line to be formed has only one point within a given pixel, then the data of that point will be stored to identify the brightness value for that pixel. Thus, each pixel will have a digital color brightness value stored in its buffer memory location indicative of the brightness at one of the 16 points making up the pixel. As the timing of the successive display of the pixel points can cause movement and distortions in the stroke line actually displayed (aliasing), to achieve anti-aliasing a set of shading profiles is used that consist of 16 prestored profiles containing various pixel grids that preferably will provide a Gaussian profile for the displayed line.

Figure 5:
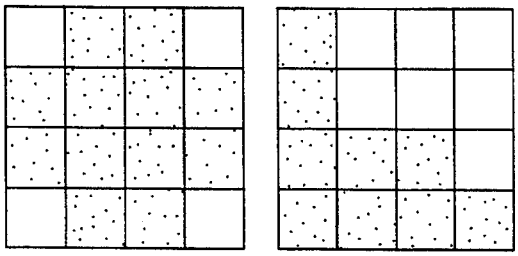
FIG. 5 illustrates a matrix of 16 disc profiles with 2 exemplary shadings that may be used in line anti-aliasing.

More particularly, to allow for the fact that a line can be drawn at any angle across the display, the shading profiles are stored in circular or disc form and each extends over or covers a number of square pixels. The discs should have profile centers that correspond as accurately as possible to points on the ideal (mathematical) center of the stroke line, so that a number of circles may be predetermined using, for example, centers offset in the X and Y direction by fractions of a pixel spacing, that is, the center offsets may be 0, ¼, ½, and ¾ of a pixel in both the X and Y directions. In any event, 16 circular intensity maps in the form of 4×4 pixel grids, such as shown in FIG. 5, may be prepared containing intensity codes that result in a circular profile, for example, Gaussian, linear, or any desired template. The center offsets are indicated in the figure by an x in each grid and the numbers in the pixels correspond to relative shadings. The two profiles at the top of the figure illustrate exemplary disc shadings. These profiles, respectively corresponding to the 16 point locations within a pixel, are stored for use in a disc generator during the processing of the data in the stroke frame buffer 43. That processing is as follows.

The LCD controller 37 (FIG. 3), which implements the function of sequencer 13 in FIG. 1, provides a read address signal to a disc generator that includes, for example, a Gaussian disc PROM 45 (top of FIG. 4), in combination with circuitry 48, consisting of two application specific integrated circuits (ASICs) 48*a* and 48*b* with associated FIFO memories 48*c* and 48*d*, that takes part in processing the stroke pixel signals using data directly input from the stroke frame buffer 43. The disc PROM 45 stores the predetermined circular or disc profiles that will be appropriately selected and assembled to create the stroke line image on the display. The read address signal causes the 16 profiles to be downloaded from PROM 45 to the ASICS 48*a* and 48*b*. The fractional X and Y bits and the RGB color intensity data indicative of the points of a stroke line are fed from the stroke frame buffer memories 43*a* and 43*b* in sequence left to right and top to bottom to the ASICs 48*a* and 48*b*.

Figure 6A:
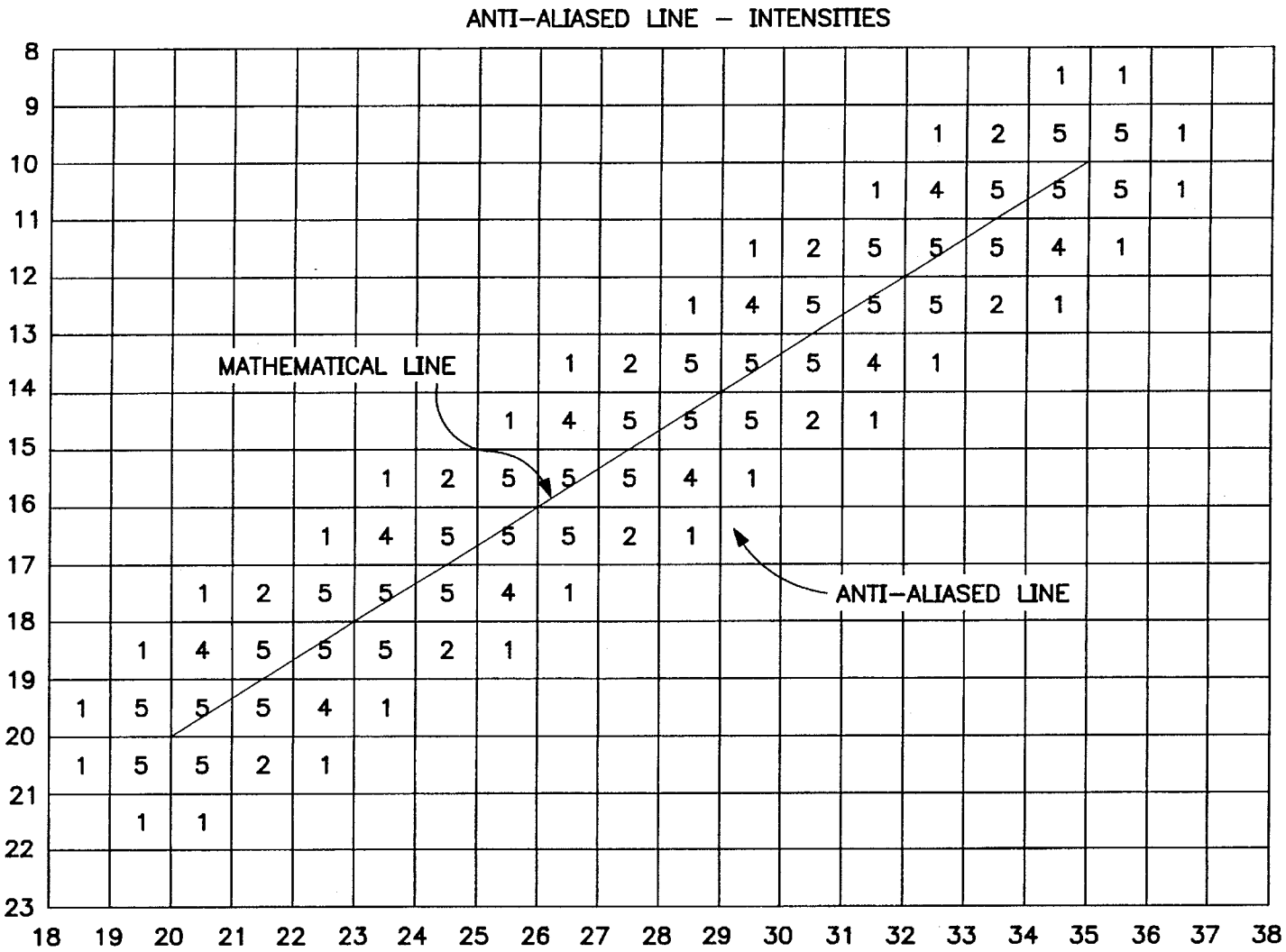
FIGS. 6A, 6B and 6C illustrate a series of steps in which the profiles of FIG. 5 are used for anti-aliasing.
Figure 6B:
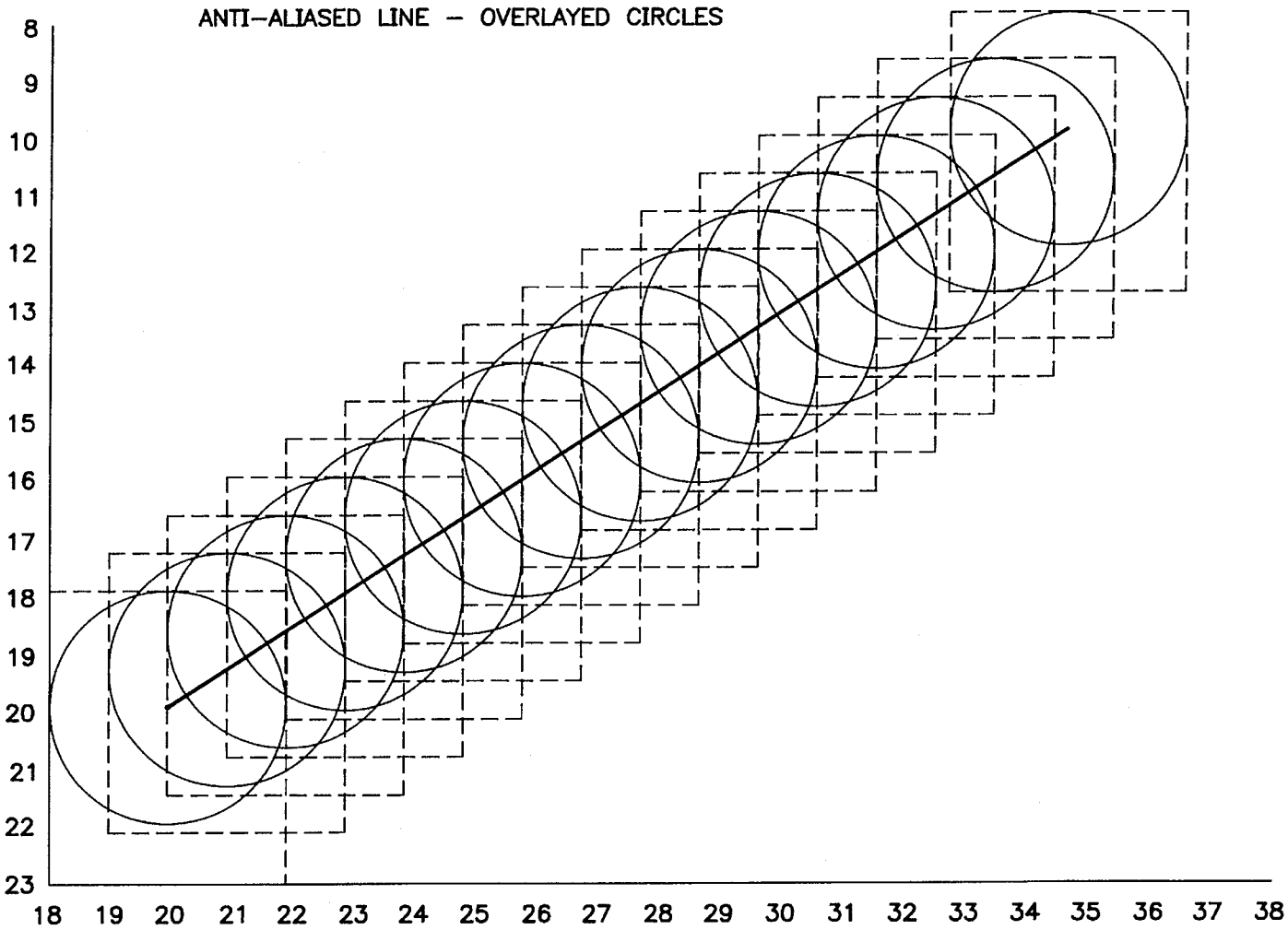

The predetermined circular intensity profile or disc with its center related to or nearest each digitized point retrieved from the frame buffer is then copied into an n×n memory within the ASICs. This corresponds to an n×n grid area around each pixel. Then, as shown in FIG. 6B, processing of the digital point intensity data is continued and, at each pixel, the last point indicated by the digital data signals is selected and the previous point data for that pixel discarded.

When, during processing, a subsequent disc is selected which has a pixel in its profile that overlaps a pixel from a profile previously copied into memory, the two pixel intensities are compared and the one with the larger value is retained in memory and the smaller value is discarded (this is called a MAX function).

Figure 6C:
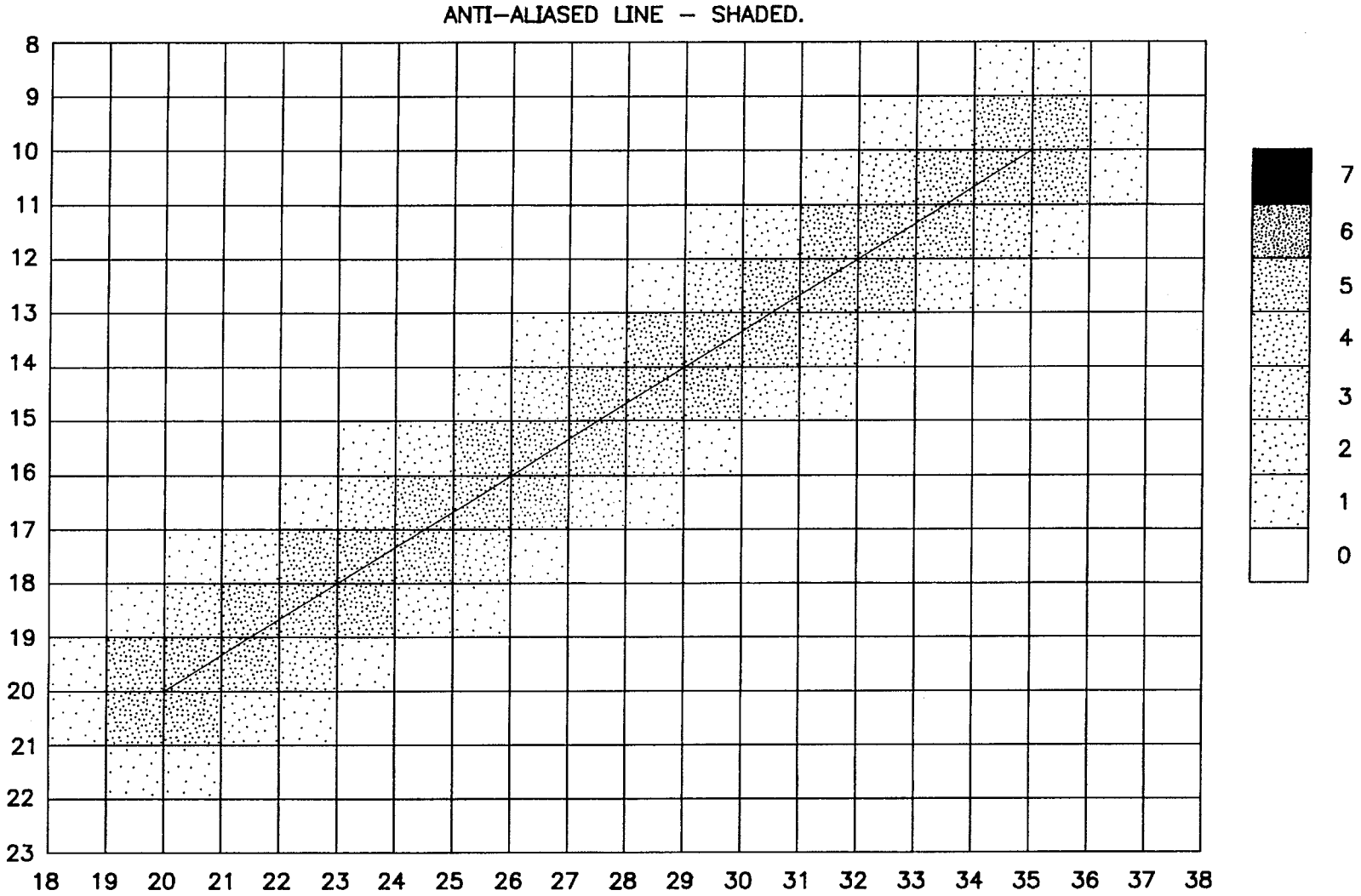

The disc profiles are thus successively loaded in overlapping relationship into memories 48*c* and 48*d* as square pixel arrays and the profiles repeatedly generated (FIG. 6B), using a maximizing algorithm (MAX function) which ensures that the brighter points are retained along the ideal center of the stroke line until the end of the line is reached. An example of the resulting line shading is illustrated in FIG. 6C.

As mentioned above, the first or starting point of the line is selected and saved to be indicative of the brightness of the pixel in which it is located, which is the pixel with its center closest to the starting point. As shown in FIG. 6A, the line ends can be positioned on a sub-pixel grid.

The application of this mode of operation in the system of the invention makes it possible to form a high resolution, anti-aliased line on a flat panel LCD display that is nearly identical to a stroke line on a CRT. Consequently, the disc generator (PROM 45 and circuitry 48) functions in the manner of a filter which shapes a beam, micropositions the beam to within ¼ pixel and covers several pixels so that any positional variation in intensity is limited to a ¼ pixel. This technique also ensures that crossing lines blend smoothly and lines can be anti-aliased to any color or video background.

Returning to the system shown in FIG. 4, it will be seen that all 24 bits on the brightness bus 31, representing the R, G1, B, and G2 signals (FIG. 1) are input to a data multiplexer 41*c*, which provides inputs to raster frame buffer memories 41*a* and 41*b*. The data multiplexers 41*c* control which side, the ping memory (41*a*) or the pong memory (41*b*), accepts the brightness data. The raster frame buffer 41 may have 512×1024 positions in each memory with 4 six bit planes for the R, G1, G2, B colors.

The outputs of the raster frame buffer 41 are coupled through a data multiplexer 41*d* to a bilinear or interpolation circuit 46 that is part of an ASIC and which feeds raster pixel or video signals to a stroke/raster mixer 47 that is part of a gate array. The outputs of the stroke scan frame buffer 43 are processed through ASICs 48*a* and 48*b* and memories 48*c* and 48*d*, as explained above, which in turn provide stroke pixel signals to the stroke/raster mixer 47. The output of the mixer 47 is fed to an LCD data flow controller 49 which provides the appropriate LCD pixel signals to an LCD raster display device 15 (FIG. 1) based on the raster and stroke pixel signals input to mixer 47. A video image having a stroke image overlay results on the display.

Additional system components to facilitate the rasterization of the two images are also shown in FIG. 4. Respective 11 bit signals on the X position bus and the Y position bus are input to a raster system controller unit 53 which contains a number of raster system components, such as ramp start/stop registers that produce an output to a raster scaler and translator sync processor, a microcontroller, and a random access memory and EPROM. Controller unit 53 additionally receives an input from microcontroller bus 50 which is also input to a transceiver 54 that is part of the stroke scan converter circuitry 30 and receives an input from the disc generator.

The raster system controller unit 53 also receives raster/stroke, V drive, H drive, raster blanking, and backup video clock inputs and outputs a 2X video clock signal to phase clock generator 34, field ½, hblank, and vblank signals to video update controller 38, and microcontroller control signals, in running the raster system to produce the video image.

It will therefore be seen that a system and method are disclosed for converting analog XYZ calligraphic video signals to digital data that can be suitably stored in a conventional sized buffer memory and used to produce a high resolution, anti-aliased stroke image which image may be overlaid on a conventional video image, and displayed on a flat panel LCD raster display.

What is claimed is:

1. Apparatus for processing analog XYZ calligraphic video signals by converting them to digital data suitable for presentation on a raster display, comprising:

frame buffer memory means for storing digital video data to be displayed on a raster display, said memory means having storage locations with row and column addresses corresponding to locations on the surface of the display;

first means for receiving and converting analog signals, indicative of X-deflection locations on said display, to digital signals indicative of corresponding column addresses in said memory means;

second means for receiving and converting analog signals, indicative of Y-deflection locations on said display, to digital signals indicative of corresponding row addresses in said memory means;

third means for receiving and converting analog signals, indicative of the brightness at locations on said display determined by coordinated X-deflection and Y-deflection location indicative signals, to digital signals; and fourth means for processing and storing said digital brightness signals at column and row address storage locations in said frame buffer memory means corresponding to the addresses determined by said address indicative digital signals of said coordinated X-deflection and Y-deflection location indicative signals, and for including least significant bits from said coordinated X-deflection and Y-deflection address indicative digital signals with said stored digital brightness signals at the corresponding respective column and row address locations in said memory means.

2. Apparatus as in claim 1, wherein said XYZ calligraphic video signals define the location and brightness of points defining a stroke line on said display and further comprising means for selecting and storing the address indicative digital signals of the X-deflection and Y-deflection location indicative signals and the digital brightness signals of the starting point of said stroke line.

3. Apparatus as in claim 1, further comprising disc generating means for producing pixel profiles in accordance with said stored brightness signals and least significant bits.

4. Apparatus as in claim 3, wherein said raster display comprises a matrix of pixels and said disc generating means comprises disc PROM means for storing a set of predetermined circular profiles comprising square pixel grids within said matrix and having their centers variously offset in the X and Y directions by fractions of a pixel.

5. Apparatus as in claim 1, wherein said frame buffer memory means comprises a stroke frame buffer memory and a raster frame buffer memory.

6. Apparatus as in claim 1, wherein said first means and said second means each comprise a 12-bit A/D flash converter.

7. Apparatus as in claim 1, wherein said third means comprises a 7-bit A/D flash converter.

8. Apparatus as in claim 1, wherein said third means comprises an ON/OFF comparator.

9. Apparatus as in claim 1, further comprising sequencer means, coupled to said frame buffer memory means and to a raster display, for controlling the transfer of said digital brightness signals to drive said raster display.

10. A method for processing analog XYZ calligraphic video signals by converting them to digital data in a frame buffer memory having storage locations with row and column addresses corresponding to pixel locations on the surface of a raster scan display on which the signals are used to produce a stroke or graphic image, comprising the steps of:

receiving and converting analog signals, indicative of X-deflection locations on said display, to digital signals indicative of corresponding column addresses in said frame buffer memory;

receiving and converting analog signals, indicative of Y-deflection locations on said display, to digital signals indicative of corresponding row addresses in said frame buffer memory;

receiving and converting analog signals, indicative of the brightness at locations on said display determined by coordinated X-deflection and Y-deflection location indicative signals, to digital signals; and storing said digital brightness signals at column and row address storage locations in said frame buffer memory corresponding to the addresses indicated by said indicative digital signals of said coordinated X-deflection and Y-deflection location indicative signals, and including least significant bits from said coordinated X-deflection and Y-deflection converted digital signals with said stored digital brightness signals at the corresponding respective column and row addresses in said frame buffer memory for use in producing a line of said stroke image.

11. A method as in claim 10, wherein each column and row address in said frame buffer memory has a corresponding pixel located on the raster display and each X-deflection and Y-deflection location has a corresponding point of said line of said stroke image located on the raster display and further comprising the steps of:

predetermining a set of circular intensity profiles or discs comprising square pixel grids with respective centers variously offset in the X and Y directions by fractions of a pixel spacing from a point of a stroke line to be generated on the raster display;

determining on the raster display the nearest pixel center to the starting point of said stroke line to be generated and selecting the pixel with that center;

copying to the area around the selected pixel in storage the predetermined circular intensity profile or disc with its center nearest the starting point of said line to be generated;

moving along said line by one pixel at a time in the line's "major" direction and, at each pixel, selecting the last point in the pixel indicated by the X-deflection and Y-deflection converted digital signals and discarding the previous point indicative X-deflection and Y-deflection converted digital signals for that pixel;

for each pixel, selecting the disc with its center related to or nearest the selected point and copying its profile into storage;

successively copying in overlapping relationship into storage the discs so selected as square pixel grids along the points defined by the X-deflection and Y-deflection converted digital signals for the stroke line until the end of the line is reached.

12. A method as in claim 11, comprising the further steps of:

when a pixel in the selected disc profile overlaps a pixel from a profile previously copied into storage, comparing the two pixel intensities; and retaining the larger intensity in storage and discarding the smaller intensity.

13. A method as in claim 10, wherein said XYZ calligraphic video signals comprise indicative digital data that defines the location and brightness of the points of a stroke line on said display and further comprising the step of saving the stored X-deflection and Y-deflection address indicative digital signals and brightness indicative digital signals of the starting point of said stroke line.

14. A method as in claim 13, wherein said XYZ calligraphic video signals define the location and brightness of a number of points of the stroke line following said starting point, with more than one of said points being located in at least one pixel, and comprising the step of selecting the indicative digital data for the last of said points in said one pixel and discarding the indicative digital data for the previous points in said pixel.

15. A method as in claim 10, wherein said least significant bits comprise 2 LSB bits from each of said coordinated X-deflection and Y-deflection converted digital signals.

16. A method as in claim 15, further comprising the step of predetermining a set of 16 circular intensity profiles or discs comprising square pixel grids with respective centers variously corresponding to positions defined by said 2 LSB bits from each of said coordinated X-deflection and Y-deflection converted digital signals.

17. Apparatus as in claim 2, wherein each column and row address in said frame buffer memory has a corresponding pixel located on the raster display and each X-deflection and Y-deflection location has a corresponding point of said line of said stroke image located on the raster display, and wherein said means for selecting and storing the address indicative digital signals of the X-deflection and Y-deflection location indicative signals and the digital brightness signals of the starting point of said stroke line further comprises:

means for predetermining a set of circular intensity profiles or discs comprising square pixel grids with respective centers variously offset in the X and Y directions by fractions of a pixel spacing from a point of a stroke line to be generated on the raster display;

means for determining on the raster display the nearest pixel center to the starting point of said stroke line to be generated and selecting the pixel with that center;

means for copying to the area around the selected pixel in storage the predetermined circular intensity profile or disc with its center nearest the starting point of said line to be generated;

means for moving along said line by one pixel at a time in the line's "major" direction and, at each pixel, selecting the last point in the pixel indicated by the X-deflection and Y-deflection converted digital signals and discarding the previous point indicative X-deflection and Y-deflection converted digital signals for that pixel;

means for selecting, for each pixel, the disc with its center related to or nearest the selected point and copying its profile into storage; and means for successively copying in overlapping relationship into storage the discs so selected as square pixel grids along the points defined by the X-deflection and Y-deflection converted digital signals for the stroke line until the end of the line is reached.

18. Apparatus as in claim 17, further comprising:

means for comparing the intensities of a pixel in a selected disc profile which overlaps a pixel from a profile previously copied into storage; and means for retaining the larger intensity in storage and discarding the smaller intensity.

19. Apparatus as in claim 1, wherein said fourth means stores 2 LSB bits from each of said coordinated X-deflection and Y-deflection converted digital signals as said least significant bits.

20. Apparatus as in claim 3, wherein said disc generating means further comprises a set of 16 predetermined circular intensity profiles comprising square pixel grids with respective centers variously corresponding to positions defined by said least significant bits from said coordinated X-deflection and Y-deflection converted digital signals.

* * * * *